United States Patent [19]

Suzuki et al.

[11] Patent Number: 5,073,741

[45] Date of Patent: Dec. 17, 1991

[54] IGNITER PLUG

[75] Inventors: Takahiro Suzuki; Noboru Aoki, both of Nagoya, Japan

[73] Assignee: NGK Spark Plug Co., Ltd., Nagoya, Japan

[21] Appl. No.: 635,730

[22] Filed: Dec. 28, 1990

[30] Foreign Application Priority Data

Dec. 29, 1989 [JP] Japan ..... 1-343693

[51] Int. Cl.[5] ..... H01T 13/02

[52] U.S. Cl. ..... 313/138; 313/131 A; 313/144

[58] Field of Search ..... 313/138, 144, 131 A, 313/131 R

[56] References Cited

U.S. PATENT DOCUMENTS

| | | | |
|---|---|---|---|
| 965,585 | 7/1910 | Jones | 313/144 X |
| 3,745,400 | 7/1973 | Meyer | 313/138 X |
| 4,952,837 | 8/1990 | Matsumura et al. | 313/144 X |

*Primary Examiner*—Palmer C. DeMeo
*Attorney, Agent, or Firm*—Cooper & Dunham

[57] ABSTRACT

An igniter plug has a tubular metallic shell and an annular ground electrode each connected in series by an interfitting, and fixed by welding. The igniter plug further has a tubular insulator placed within both the metallic shell and the ground electrode, while a center electrode is placed within the insulator to be surrounded by the ground electrode. A plurality of lock arms are provided with a front end of the metallic shell, and each top end of lock arms has a pawl which is brought into an engagement with an inner wall of a groove which is provided with an inner surface of the ground electrode when the metallic shell and the ground electrode are connected, and at the same time, the insulator is brought into an engagement with an inner side of each lock arm to deter the lock arms from being flexed inwardly when the insulator is placed.

3 Claims, 4 Drawing Sheets

IGNITER PLUG

BACKGROUND OF THE INVENTION

1. Field of the Invention

This invention relates to an igniter plug for use in an internal combustion engine, gas turbine engine, diesel engine, gas burner and oil burner, and particularly concerns to an igniter plug in which a metallic shell and a ground electrode are connected by means of interfitting.

2. Description of Prior Art

In an igniter plug (C) usually employed to an internal combustion engine 101, a metallic shell 100 and a ground electrode 200 are discretely made from stenless steel and tungsten in turn as seen in FIG. 4. The ground electrode 200 is connected in series with a front end 110 of the metallic shell 100 by means of interfitting, and the connection between the shell 100 and the electrode 200 is fixed by welding as indicated by numeral 300. Within the shell 100 and the electrode 200, a tubular insulator 400 is placed with its inner space as an axial bore 410 into which a center electrode 500 is inserted.

With a recent high-output performance of the internal combustion engine 101, the ambient temperature within a combustion chamber 600 tends to rise so that the welding portion 300 may collapse by an excessive oxidation to fall the ground electrode 200 off the metallic shell 100 so as to do a damage to the engine since the electrode 200 is simply interfit into the shell 100. For this reason, it has been required to prevent the ground electrode 200 from accidentally falling off the metallic shell 100.

Therefore, it is an object of the invention to provide an igniter plug which is capable of prevent a ground electrode from accidentally falling off a metallic shell even when a welding portion between the electrode and the shell is collapsed by an excessive oxidation so as to contribute to an extended period of service life, and achieving this effect with a relatively simple construction.

SUMMARY OF THE INVENTION

According to the invention, in an igniter plug comprising a tubular metallic shell and an annular ground electrode each connected in series by an interfitting, and fixed by means of welding or brazing, the igniter plug further having a tubular insulator concentrically placed within both the metallic shell and the ground electrode, while a center electrode is concentrically placed within the insulator to be surrounded by the ground electrode, there is provided an igniter plug having a plurality of lock arms circumferentially provided with either of a rear end of the ground electrode or a front end of the metallic shell by providing axial slits therewith, and each of the lock arms having a pawl at its top end; a groove circumferentially provided with an inner surface of the rest of the ground electrode or the metallic shell to be in registration with the pawls of the lock arms, whereby the lock arms elastically flexes to bring the pawls into an engagement with an inner wall of the groove when the metallic shell and the ground electrode are connected in series, and at the same time, the insulator is brought into an engagement with an inner side of each lock arm to deter the lock arms from being flexed inwardly when the insulator is placed.

At the time of connecting the ground electrode to the metallic shell, the lock arms engage the pawls with the inner wall of the groove, while the insulator is brought into the engagement with the inner surface of the lock arm to block the electrode against separation from the metallic shell, thus capable of preventing a ground electrode from accidentally falling off a metallic shell even when a welding portion between the electrode and the shell is collapsed by an excessive oxidation so as to contribute to an extended period of service life, and achieving these effects with a relatively simple construction.

These and other objects and advantages of the invention will be apparent upon reference to the following specification, attendant claims and drawings.

DETAILED DESCRIPTION OF THE EMBODIMENTS

Figure 1:
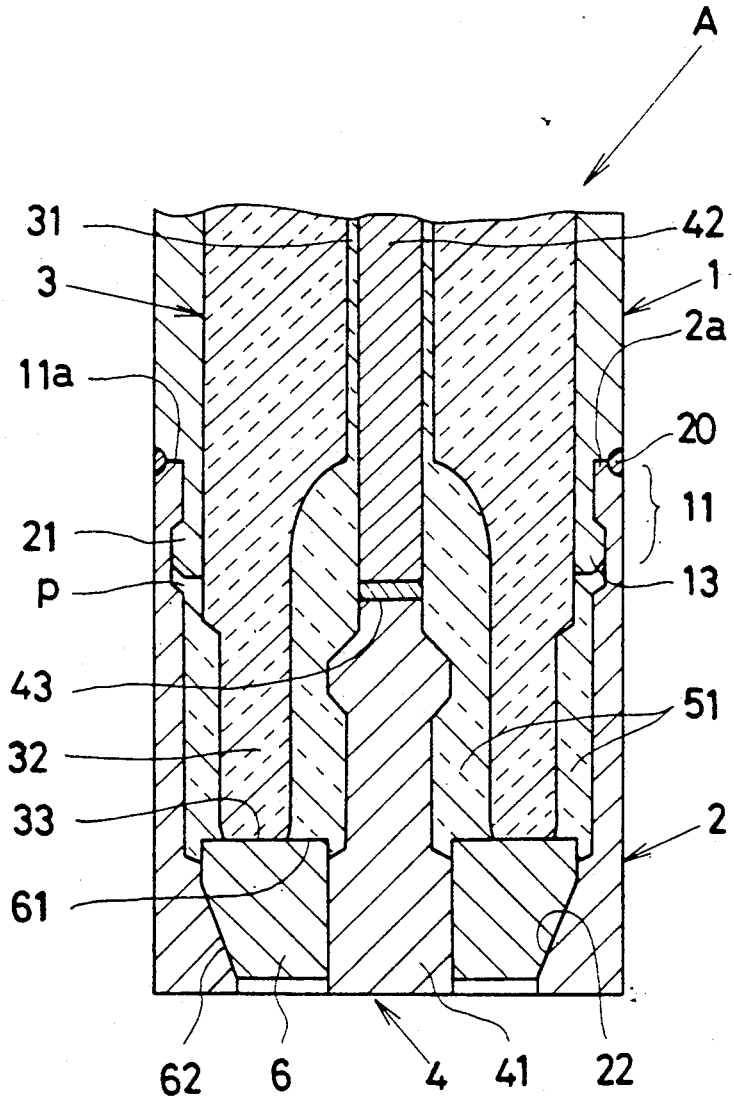
FIG. 1 is a longitudinal cross sectional view of an igniter plug according to a first embodiment of the invention, but partly broken away.

Referring to FIG. 1 in which a first embodiment of the invention is shown, denotation (A) designates an igniter plug, but partly broken away in FIG. 1. The igniter plug (A) has a tubular metallic shell 1 and an annular ground electrode 2 each connected in series by means of interfitting, and fixed at the connection between the shell 1 and the electrode 2 by means of welding as indicated at numeral 20. Into both the metallic shell 1 and the electrode 2, is a tubular insulator 3 concentrically inserted with its inner space as an axial bore 31 into which a center electrode 4 is concentrically provided to be surrounded by the ground electrode 2. The metallic shell 1 is made of stainless steel, and having a male thread (not shown) at its outer surface for the purpose of mounting the igniter plug on an engine block. A front end 11 of the metallic shell 1 is diametrically reduced at a step portion 11*a* so that an outer diameter of the front end 11 is substantially equal to an inner diameter of the ground electrode 2. With the front end 11 of the metallic shell 1, thus diametrically reduced, are twelve number of lock arms 13 provided by circumferentially notching axial slits 12 thereon with regular intervals. Each of the lock arms 13 has an integral pawl 13*a* at its top end. The ground electrode 2 is made from tungsten-based alloy which has an erosion-resistant property, and an outer diameter of the electrode 2 is generally equivalent to that of metallic shell 1.

With an inner surface of a rear end of the metallic shell 1, is a groove 21 circumferentially provided to be in registration with the pawl 13*a* of the lock arm 13. On the other hand, an inner surface of a front end of the metallic shell 1 has a taper surface 22, an inner diameter of which progressively decreases toward a front end of the ground electrode 2. The insulator is made of a sintered ceramic body with alumina as a main component. A thickness of a front end 32 of the insulator 3 is somewhat reduced so that an inner diameter of the insulator 3 is slightly greater than an outer diameter of the center electrode 4. Within the front end of the electrode 2, is an annular semi-conductor tip 6 placed which has a rear surface 61 abutting against a front end 33 of the insulator 3, and at the same time, having an outer surface 62 seated on the taper surface 22.

In the meantime, the center electrode 4 consist of a firing tip 41 made from tungsten-based alloy which is connected in series with a axial bar 42 made from nickel-based alloy by means of welding 43. The firing tip 41 extends from a front end of the axial bar 42, and passing through the axial bore 31 to be concentrically located within the semi-conductor tip 6. In a clearance appeared among the ground electrode 2, the front end 32 of the insulator 3 and the insulator, is a glass sealant 51 filled when the glass sealant 51 is melt at a high temperature.

Figure 2:
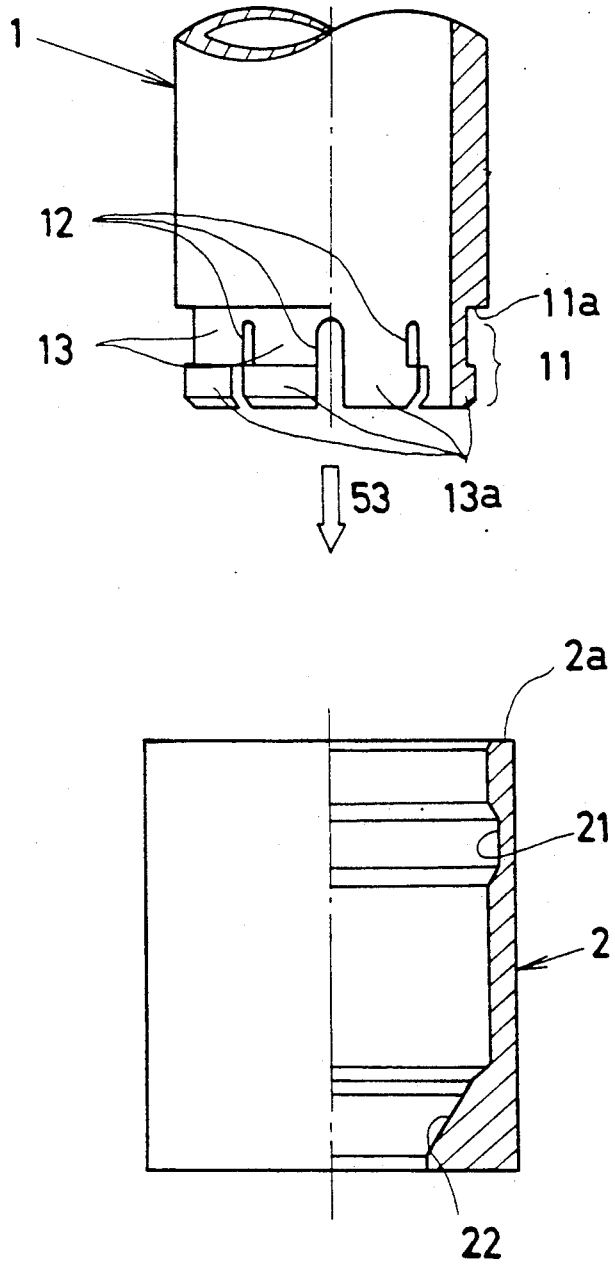
FIG. 2 an exploded view of a metallic shell and a ground electrode.

The following is a procedure to build the igniter plug (A) explained in reference to FIG. 2.

(1) The front end 11 of the metallic shell is machined by an engine lathe to reduce its outer diameter. With front end 11 of the metallic shell 1, are the axial slits 12 provided to form the lock arms 13, each of which carries the pawl 13*a* at its top end. The number of the lock arms 13 is preferably within four to twenty. When the number of the lock arms decreases to three or less than three, the lock arms are unlikely to elastically flex. When the number of the lock arms exceeds to twenty, each width of the lock arms tends to diminish so as to be short of strength as a whole.

(2) The groove 21 is provided with the inner surface of the ground electrode 2.

(3) The metallic shell 1 interfits its front end 11 into the rear end of the ground electrode 2 as indicated by an arrow 53 so as to make the lock arms 13 elastically flex to bring the pawls 13*a* into an engagement with the inner wall of the groove 21. At this time, the step portion 11*a* of the metallic shell 1 butts on the rear end 2*a* of the ground electrode 2. The axial length of the pawl 13*a* is determined to be somewhat smaller than a width of the groove 21 so as to provide a space (p) which allows to absorb shrinkage after the metallic shell 1 and the ground electrode 2 are welded.

(4) The portion in which the step portion 11*a* of the metallic shell 1 butts on the rear end 2*a* of the ground electrode 2 is welded as designated by numeral 20.

(5) The glass sealant 51 is filled, and at the same time, the semi-conductor tip 6 is placed within the ground electrode 2.

(6) The insulator 3, which carries the center electrode 4, is inserted into both the metallic shell 1 and the ground electrode 2 so as to be brought into an engagement with an inner surface of each lock arm 13, and thus deterring the lock arm from flexing inwardly.

As apparent from the foregoing description, the lock arms are brought the pawls into an engagement with the inner wall of the groove, while the insulator is brought into the engagement with the inner surface of the lock arm to block the electrode against separation from the metallic shell, thus capable of preventing a ground electrode from accidentally falling off a metallic shell to do damage to an engine even when a welding portion between the electrode and the shell is collapsed by an excessive oxidation so as to contribute to an extended period of service life, and achieving these effects with a relatively simple construction and less cost.

Figure 3:
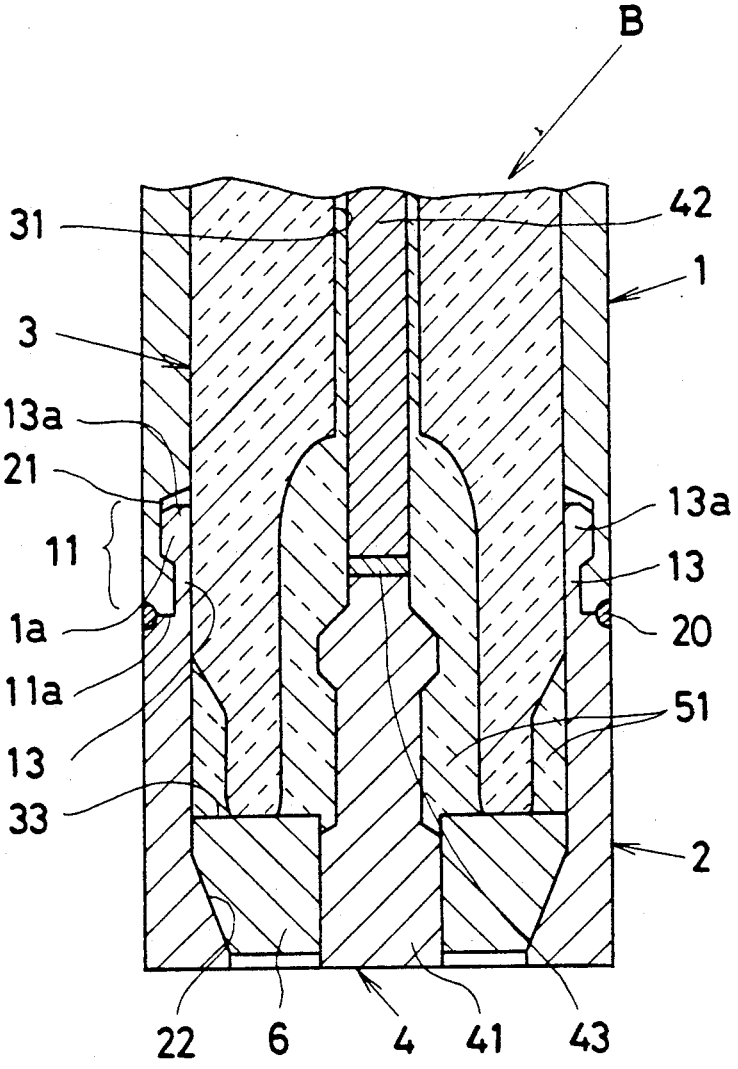
FIG. 3 is a view similar to FIG. 1 according to a second embodiment of the invention.
Figure 4:
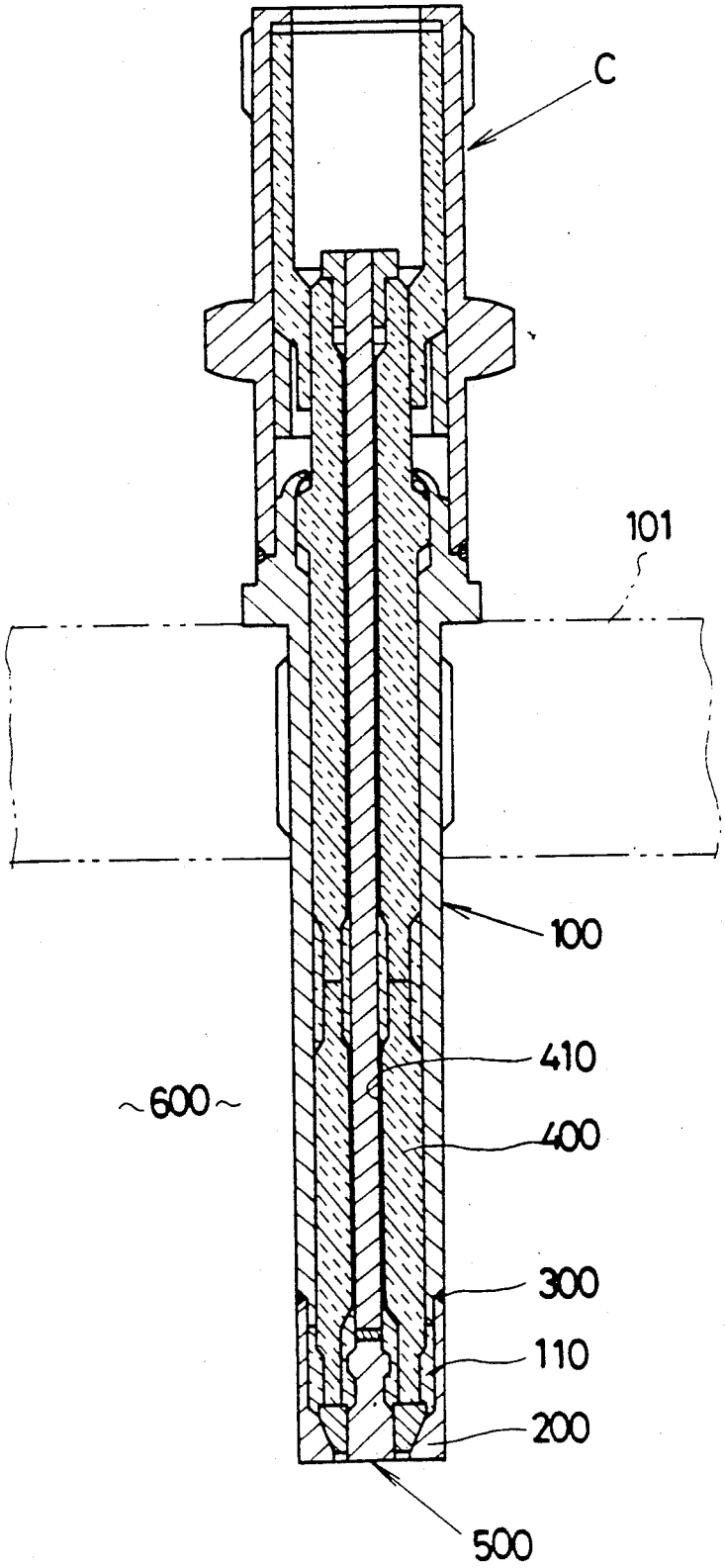
FIG. 4 is a prior igniter plug mounted on an internal combustion engine.

FIG. 3 shows a second embodiment of the invention in which like reference numerals in FIG. 3 is identical to those in FIG. 1. In an igniter plug (B) according to the second embodiment of the invention, the groove 21 is provided with an inner surface of the metallic shell 1, while the lock arms 13 are proided with a rear end of the ground electrode 2 in a manner similar to that mentioned in the first embodiment of the invention. Each pawl 13*a* formed on the lock arms 13 is brought into an engagement with the inner wall of the groove 21 when the metallic shell 1 is connected to the ground electrode 2. In accompany with this connection, the step portion 11*a* of the ground electrode 2 abutts on a front end 1*a* of the metallic shell 1, and fixed by means of welding 20. The case mentioned in the second embodiment is particularly advantageous when the ground electrode 2 is anticipated to have an elastic property.

It is noted that the insulator 3 may be brought into an engagement with the inner surface of the lock arms 13 by way of the glass sealant 51, the semi-conductor tip 6 or a ring (not shown).

It is appreciated that the portions in which the metallic shell 1 and the ground electrode 2 are interfit each other, may be in the form of polygon to prevent relative rotation when the welding portion 20 is collapsed.

It is further noted that the connection between the metallic shell 1 and the ground electrode 2 is fixed by means of spot welding or electrical resistant welding, instead of the welding the metallic shell 1 and the ground electrode 2 may be fixed by means of brazing.

While the invention has been described with reference to the specific embodiments, it is understood that this description is not to be construed in a limitting sense in as much as various modifications and additions to the specific embodiments may be made by skilled artisan without departing from the spirit and scope of the invention.

What is claimed is:

1. In an igniter plug comprising a tubular metallic shell and an annular ground electrode each connected in series by an interfitting, and fixed by means of welding or brazing, the igniter plug further having a tubular insulator concentrically placed within both the metallic shell and the ground electrode, while a center electrode is concentrically placed within the insulator to be surrounded by the ground electrode;

the improvement comprising;

a plurality of lock arms circumferentially provided with either of a rear end of the ground electrode or a front end of the metallic shell by providing axial slits therewith, and each of the lock arms having a pawl at its top end;

a groove circumferentially provided with an inner surface of the rest of the ground electrode or the metallic shell to be in registration with the pawls of the lock arms, whereby the lock arms elastically flexes to bring the pawls into an engagement with an inner wall of the groove when the metallic shell and the ground electrode are connected in series, and at the same time, the insulator is brought into an engagement with an inner side of each lock arm to deter the lock arms from being flexed inwardly when the insulator is placed.

2. In an igniter plug as recited in claim 1, the lock arms are provided with a front end of the metallic shell, while the groove provided with an inner surface of the rear end of the ground electrode.

3. In an igniter plug as recited in claim 1, the lock arms are provided with a rear end of the ground electrode, while the groove provided with an inner surface of the front end of the metallic shell.

* * * * *